United States Patent [19]

Craig

[11] 4,175,720

[45] Nov. 27, 1979

[54] RETAINER/RELEASE MECHANISM FOR USE ON FIN STABILIZED GUN FIRED PROJECTILES

[75] Inventor: W. Dale Craig, King George, Va.

[73] Assignee: The United States of America as represented by the Secretary of the Navy, Washington, D.C.

[21] Appl. No.: 893,635

[22] Filed: Apr. 5, 1978

[51] Int. Cl.[2] ..... F42B 13/32

[52] U.S. Cl. ..... 244/3.28

[58] Field of Search ..... 244/3.27, 3.28

[56] References Cited

U.S. PATENT DOCUMENTS

| | | | |
|---|---|---|---|
| 2,801,587 | 8/1957 | Gould | 244/3.28 |
| 3,174,430 | 3/1965 | Apotheloz | 244/3.28 |
| 4,143,838 | 3/1979 | Holladay | 244/3.28 |

FOREIGN PATENT DOCUMENTS

| | | | |
|---|---|---|---|
| 1273342 | 8/1961 | France | 244/3.28 |

*Primary Examiner*—Verlin R. Pendegrass

[57] ABSTRACT

The tail section of a fin-stabilized, guided projectile having centrifugally deployed fins is disclosed. A fin retainer and release mechanism engages the projectile fins and holds the fins within the projectile diameter during normal stowage, handling and travel of the projectile down the gun tube. The fin retainer and release mechanism is designed to operate from the forces of gun launch to enable centrifugal deployment of the fins due to projectile rotation after the projectile leaves the gun tube.

2 Claims, 3 Drawing Figures

RETAINER/RELEASE MECHANISM FOR USE ON FIN STABILIZED GUN FIRED PROJECTILES

BACKGROUND OF THE INVENTION

1. Field of the Invention

This invention relates generally to guided projectiles and more particularly to a mechanism for holding the stabilizing fins of a guided projectile in stowed positions until the projectile has exited from the gun tube.

2. Description of the Prior Art

When launching a fin-stabilized projectile it is necessary to retain the fins within the projectile diameter during travel down the gun tube to avoid damage to both the fins and the gun tube. Once the projectile is in flight, the fins must be released to deploy centrifugally for in-flight stability since this type of projectile is not normally spin stabilized. One earlier design utilized a pressure chamber and shear wire combination to provide the retaining and release functions. Many rounds have been fired using this earlier retainer, but various problems developed and the retainer was not found to be reliable nor was opening or deployment as smooth as required.

SUMMARY OF THE INVENTION

With the foregoing problems in mind, the present invention contemplates a fin latch disposed within the circle of folded fins and engaging the fins to normally hold them in the stowed positions. A retainer is provided to hold the fin latch in engagement with the fins during handling and stowage and is designed to fail at the beginning of gun launch. The fin latch is designed to remain in engagement with the fins during travel down the gun tube after the retainer has failed and to release the fins for centrifugal deployment, due to projectile spin, when the projectile leaves the gun tube.

STATEMENT OF THE OBJECTS OF THE INVENTION

It is a primary object of this invention to provide a new and improved fin retainer and release mechanism for the centrifugally deployed stabilizing fins on a guided projectile.

It is another object of the present invention to provide a fin retainer and release mechanism which has no moving parts.

It is a further object of this invention to provide a fin retainer and release mechanism which is operable solely from the forces of projectile launch.

BRIEF DESCRIPTION OF THE DRAWINGS

Other objects, advantages and novel features of the invention will become readily apparent upon consideration of the following detailed description when read in conjunction with the accompanying drawings wherein.

DESCRIPTION OF THE PREFERRED EMBODIMENT

Figure 1:
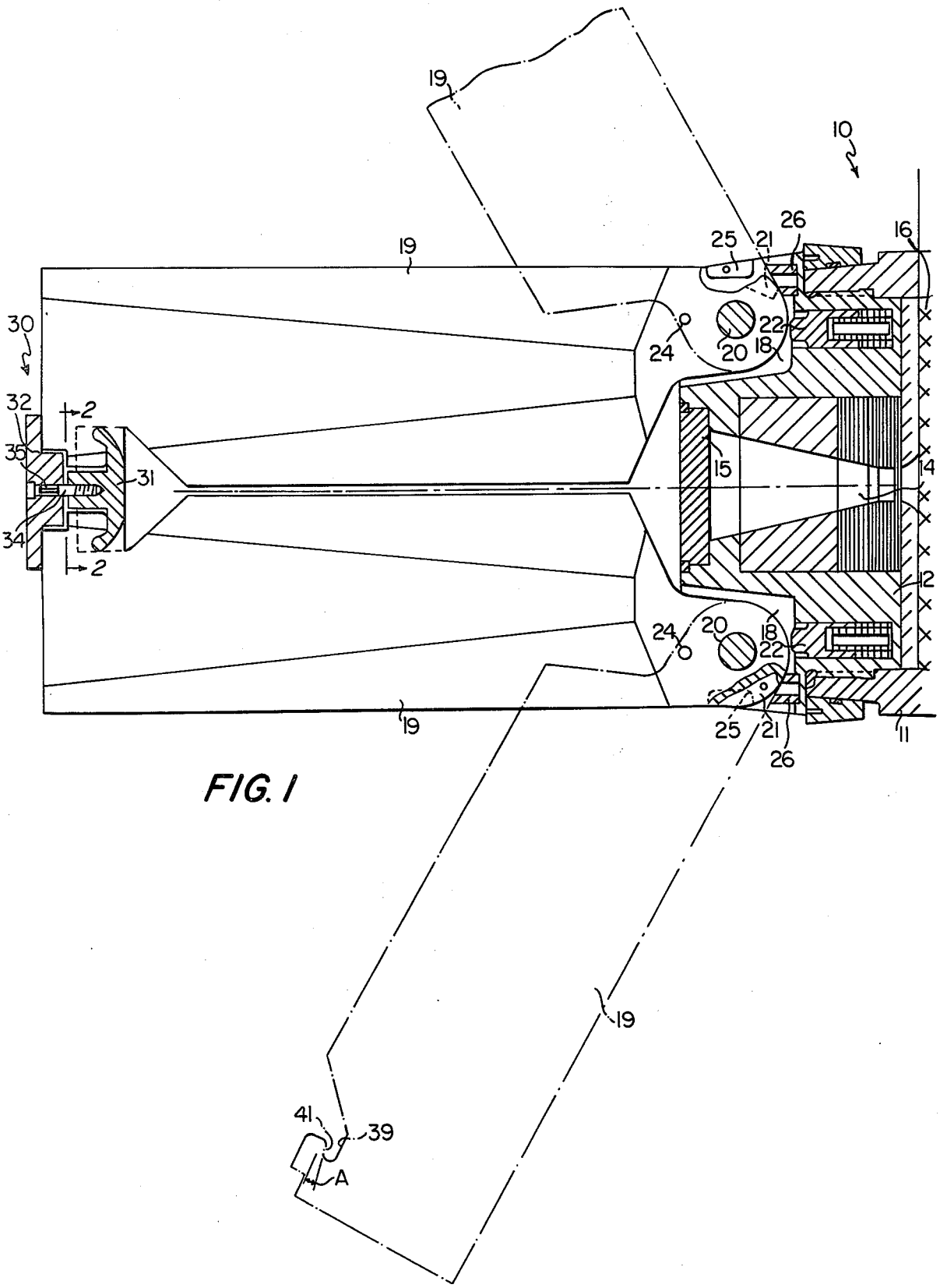
FIG. 1 is a sectional view of the tail portion of a fin-stabilized, guided projectile illustrating the fin retainer and release mechanism of the present invention in their operable positions and including a fragmentary illustration in dotted lines of the fins in their deployed positions.

Attention now is directed to the drawings, wherein like numerals of reference designate like parts throughout the several views, and more particularly to FIG. 1 wherein there is illustrated the tail section of a fin-stabilized, gun-launched, extended-range, guided projectile, designated generally by the reference numeral 10. Only the tail section is shown because the invention disclosed herein is applicable to any projectile or missle which utilized centrifugally deployed stabilizing fins. A projectile body 11 has a base 12 fixed therein. A rocket nozzle 14 is formed in the base 12 and protected during handling and stowage by a cover plate 15. The rearward section of the projectile body 11 contains a quantity of rocket propellant 16 which, when ignited, serves to give this particular projectile its extended range. Since the operation of the rocket motor on this projectile is not germane to the present invention, it will not be further described.

The base 12 is provided with a plurality of circumferentially spaced slots 18 which accomodate the forward ends of a plurality of stabilizing fins 19 that are pivotally mounted in the slots 18 by means of pivot pins 20. Each fin 19 is provided with a pin stop slot 21 into which a spring loaded pin 22, mounted in the base 12, will drop, when the fin has deployed to the position shown in dotted lines in FIG. 1, to lock the fin in the deployed position. Each fin 19 is also provided with a pair of ball locks 24 with a spring (not shown) interposed there between and are normally held entirely within the mounting hole in the fin 19 by engagement with the side walls of the slots 18. When the fins 19 deploy to the positions in dotted lines in FIG. 1, the ball locks will be projected halfway out of the mounting holes and into ball lock slots 25, formed in the side walls of the slots 18, to lock the fins 19 in their deployed positions. Thus, the pins 22 and ball locks 24 serve to provide redundant stops to lock the fins 19 in their deployed positions. Slots 18 are also provided with stops 26 which are tubular in configuration and constructed of a relatively soft metal. The stops 26 are intended to be partially crushed in decelerating the deploying fins since the centrifugal forces involved are quite large.

During handling and stowage, the fins 19 are retained in the positions shown in FIG. 1 by means of a retainer and release mechanism designated generally by reference numeral 30. The retainer and release mechanism 30 comprises a fin latch 31, a retainer plate 32 and a pin 34 interconnecting the fin latch 31 and retainer plate 32. The pin 34 is provided with a reduced section 35 which is designed to fail in tension due to the forces of gun launch while pocessing sufficient strength to enable the mechanism 30 to hold the fins 19 in the position shown in FIG. 1 during normal handling and stowage.

Figure 2:
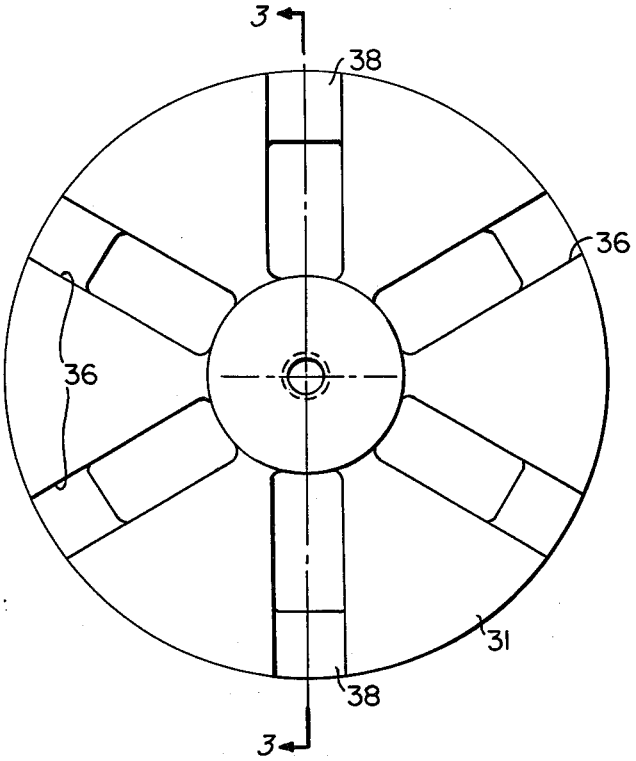
FIG. 2 is a view taken along the line 2—2 of FIG. 1 and illustrates the generally cylindrical configuration of the fin latch and the circumferentially spaced notches which engage the fins to hold them in their stowed positions.
Figure 3:
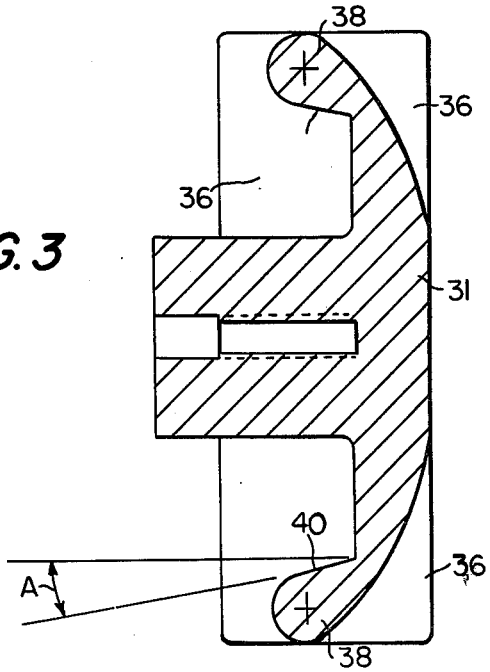
FIG. 3 is a sectional view taken along the line 3—3 of FIG. 2 and illustrates in greater detail the specific configuration of the fin engaging notches on the fin latch.

Referring now to FIGS. 2 and 3, it can be seen that the fin latch 31 is of generally cylindrical configuration and is provided with a plurality of circumferentially spaced notches 36. The notches 36 define a plurality of lobes 38 which are shaped to conform to corresponding notches 39 formed in the fins 19. Each lobe 38 has an inner surface 40 inclined at an angle A to the central axis of the fin latch 31 and each notch 39 is provided with a surface 41 inclined at the same angle A to the longitudinal axis of the fin 19. When the retainer and release mechanism 30 is fixed to the fins 19 in the position shown in FIG. 1, the surfaces 40 and 41 define a plurality of inclined plane mating surfaces sloping inwardly in the forward direction toward the projectile axis. The purpose of this configuration will be descirbed subsequently.

OPERATION

In order that a better understanding of the invention might be had, its mode of operation will now be described.

The projectile 11 is loaded into a gun tube (not shown) from which it is to be fired. The retainer and release mechanism 30 is of sufficient strength to retain the fins 19 in the position shown in FIG. 1, i.e., within the projectile diameter, during normal stowage and handling including insertion into the gun tube. When the gun is fired, the projectile 11 begins to accelerate rapidly down the gun tube engaging the rifling and beginning to spin rapidly. Since the accelerations involved are quite large (on the order of 10,000 G's) the inertial or setback forces on the retainer and release mechanism 30 are also quite large. The pin 34 immediately fails in tension in the reduced section 35 and releases the fin latch 31. Since the projectile has begun spinning quite rapidly, centrifugal forces acting on the fins 19 tend to slide the fin latch 31 forward along the inclined planes defined by the surfaces 40 and 41. However, the mass of the fin latch 31 and the angle A are selected so that the setback forces on the fin latch 31 are sufficient to overcome the centrifugal forces acting on the fins 19. Thus, the fin latch 31 remains motionless relative to the fins 19 during travel of the projectile 11 down the gun tube.

When the projectile clears the end of the gun tube the setback acceleration is no longer present and only wind drag and frictional forces prevent the fin latch 31 from moving forward. The centrifugal forces acting on the fins 19 remain constant, however, because the projectile 11 is still spinning rapidly. The centrifugal forces on the fins 19 now cause the fin latch 31 to slide forward along the inclined planes defined by the surfaces 40 and 41. When the lobes 38 clear the notches 39 the fin latch 31 drops away and the fins 19 swing rapidly outward to the position shown in dotted lines in FIG. 1. Crushing of the stops 26 decelerates the fins 19 to prevent damage, and the pins 22 and ball locks 24 function to lock the fins 19 in their stabilizing positions. The projectile is now stabilized in flight by the deployed fin and may be steered by means of any appropriate guidance system (not shown).

Obviously, many modifications and variations of the present invention are possible in the light of the above teachings. It is therefore to be understood that within the scope as of the appended claims the invention may be practiced otherwise than specifically described.

What is claimed is:

1. A retainer and release mechanism for the centrifugally deployed fins on a fin-stabilized, gun-launched, guided projectile and operable from the forces of projectile launch comprising:

a fin latch of generally cylindrical configuration provided with a plurality of circumferentially spaced notches adapted to engage similarly configured notches formed in the inner edges of the projectile fins thereby defining a plurality of inclined plane mating surfaces sloping inwardly in the forward direction toward the projectile axis, the mass of said fin latch being sufficient when acted upon by the set back or inertial forces of gun launch to hold the notches engaged and retain the fins within the projectile diameter against the urging of centrifugal forces on the fins due to projectile spin during travel down the gun tube, the mass being insufficient to retain the fins when the set back force ceases upon exit of the projectile from the gun tube whereby centrifugal forces still acting on the fins will cause the fin latch to slide forward along the inclined planes until the notches disengage and the fins are able to complete centrifugal deployment while the fin latch falls away; and means for retaining said fin latch in engagement with the fins during stowage and handling, said retaining means being designed to fail when set back forces are first applied during launch thereby releasing said fin latch.

2. A mechanism as defined in claim 1 wherein said retaining means comprises:

a retainer plate adapted to abut the trailing edges of the projectile fins; and a pin interconnecting said fin latch and said retainer plate for holding the notches in said fin latch and the projectile fins in engagement during stowage and handling, said pin being designed to fail in tension when set back forces are first applied to the projectile during launch thereby releasing said fin latch.

* * * * *